US008897661B2

(12) United States Patent
Pino

(10) Patent No.: US 8,897,661 B2
(45) Date of Patent: Nov. 25, 2014

(54) SYSTEMS AND METHODS FOR IMPLEMENTING VARIABLE SPEED TONER REMOVAL IN AN INTERMEDIATE TRANSFER ELEMENT CLEANING DEVICE

(71) Applicant: XEROX Corporation, Norwalk, CT (US)

(72) Inventor: Jason Andrew Pino, Rochester, NY (US)

(73) Assignee: XEROX Corporation, Norwalk, CT (US)

( * ) Notice: Subject to any disclaimer, the term of this patent is extended or adjusted under 35 U.S.C. 154(b) by 88 days.

(21) Appl. No.: 13/721,463

(22) Filed: Dec. 20, 2012

(65) Prior Publication Data

US 2014/0178089 A1 Jun. 26, 2014

(51) Int. Cl.
*G03G 15/16* (2006.01)
*G03G 21/00* (2006.01)

(52) U.S. Cl.
CPC ..... *G03G 15/161* (2013.01); *G03G 21/00* (2013.01); *G03G 2215/1661* (2013.01)
USPC ..... 399/71

(58) Field of Classification Search
USPC ..... 399/71, 101, 353, 354, 355
See application file for complete search history.

(56) References Cited

U.S. PATENT DOCUMENTS

2006/0039711 A1 * 2/2006 Shibuya et al. ..... 399/44

FOREIGN PATENT DOCUMENTS

JP 2007127712 A * 5/2007

OTHER PUBLICATIONS

Machine translation of JP 2007127712 A obtained on May 15, 2014.*

* cited by examiner

*Primary Examiner* — Gregory H Curran
(74) *Attorney, Agent, or Firm* — Ronald E. Prass, Jr.; Prass LLP

(57) ABSTRACT

A system and method are provided for sensing occasions of operations in image forming devices that result in larger than normal volumes of residual toner needing to be removed from an intermediate transfer element by an intermediate transfer element toner cleaning system. Based on this sensing, an operating speed for an auger component in the intermediate transfer element toner cleaning system may be temporarily increased. This temporary increase in operating speed may address the intermittent increased toner volume conditions without introducing unacceptable physical configuration changes, or undesirable operating characteristic modifications, for the intermediate transfer element toner cleaning system. Upon sensing an actual or anticipated higher-than-normal amount of toner to be removed, a signal is sent to temporarily increase a speed of operation of toner removal components in the intermediate transfer element toner cleaning system to account for the temporary increase.

13 Claims, 4 Drawing Sheets

SYSTEMS AND METHODS FOR IMPLEMENTING VARIABLE SPEED TONER REMOVAL IN AN INTERMEDIATE TRANSFER ELEMENT CLEANING DEVICE

BACKGROUND

1. Field of Disclosed Subject Matter

This disclosure relates to systems and methods for implementing intelligent variable speed operations in toner cleaning components, including an intermediate transfer element toner cleaning device, in an image forming device.

2. Related Art

The principles of operations in xerographic image forming devices are well known. Xerographic, and other toner-based, image marking units are generally used to transfer toner as the image marking medium onto an image receiving medium substrate in copiers, printers, facsimile machines and other like devices. FIG. 1 illustrates a schematic representation 100 of components that support a basic operation of a xerographic image-on-image toner-based transfer in an image forming device, including an intermediate transfer component.

As shown in FIG. 1, and as is generally understood in xerography, for example, a photoconductive transfer element may be presented in the form of photoconductor belt 110. The photoconductor belt 110 is mounted on, and driven by, a plurality of powered and follower photoconductor belt rollers 112,114. In operation, a photoconductive surface of the photoconductor belt 110 is exposed to light images emitted from a light source 120 as an imaging unit that optically exposes and selectively charges the photoconductive surface of the photoconductor belt 110 to form an electrostatic latent image on the photoconductive surface. The selectively-charged surface of the photoconductor belt 110 then passes a plurality of individual reservoirs 122-128, each supplying a different color of individually-charged toner particles. Multiple colors of charged toner particles from the plurality of individual reservoirs 122-128 are deposited onto the charged surface of the photoconductor belt 110. Each color of toner supplied from the individual reservoirs 122-128 has a charge, and will thus adhere to a particular area on the charged surface of the photoconductor belt 110 in a manner to correspondingly color the electrostatic latent image to form a multi-color toner image.

The multi-color toner image is then, in exemplary systems such as those shown in FIG. 1, transferred to an intermediate transfer element 130 at an intermediate transfer nip formed between the photoconductor belt 110 and the intermediate transfer element 130. As shown, the intermediate transfer element 130 may comprise an intermediate transfer belt, which like the photoconductor belt 110, may be mounted on, and driven by, a plurality of powered and follower intermediate transfer element rollers 132-138. Other configurations for the intermediate transfer element 13 are possible to include the intermediate transfer element 130 being in a form of a drum or a roller.

The toner image is then transferred from an intermediate transfer element 130 to an image receiving medium substrate at an image transfer nip formed between image transfer element 130 and a substrate carrying component 140 that itself rides along a series of substrate carrying component rollers 142-146.

The image transfer process is generally completed by passing the image receiving medium substrate, with the toner image formed thereon, to a fuser unit (not shown). The fuser unit is used to fuse and fix the toner image on the image receiving medium substrate through an application of heat and/or pressure in the fuser unit to the transferred toner image on image receiving medium substrate. The image receiving medium substrate, with the toner image fused and fixed thereon, is then passed to an image receiving medium substrate output collection area or tray where the user collects the finished, permanently imaged documents in the image forming device.

Between imaging operations, the photoconductive surface of the photoconductor belt 110 is refreshed by removing residual charge and toner from the photoconductive surface to make the photoconductor belt ready to repeat the process, e.g., ready to be charged, to receive toner0 and to transfer a toner image to an image receiving medium substrate.

In order to preserve image quality in the image forming device, residual toner must be cleaned and collecte from the various elements. The intermediate transfer element 130 is often subjected to a cleaning process using an intermediate transfer element toner cleaning device 150. Residual toner is removed from the intermediate transfer element 130 by the intermediate transfer element toner cleaning device 150 and is then transferred from a limited volume toner collection reservoir in the intermediate transfer element toner cleaning device 150, via a transfer passage 155, to a waste toner recovery receptacle 160.

SUMMARY OF THE DISCLOSED EMBODIMENTS

Differing operating conditions in toner-based image forming systems may result in significant amounts of residual toner to be cleaned from imaging elements, including the intermediate transfer element. Among these operating conditions, generally referred to as "stress" conditions, are high volume toner transfer operations in which excessive amounts of toner are used to create multi-colored images according to a user's desires, and toner purge operations in which excess toner is purged from the marking or developer subsystem in the image forming device through process control patches. In these purge operations, process control patches, for example, are not transferred to any image receiving medium substrate, but rather are left to be collected as waste toner by the intermediate transfer element toner cleaning system.

A typical intermediate transfer element toner cleaning system may comprise an abrasive cleaning component that contacts a toner bearing surface of the intermediate transfer element. An objective of the abrasive cleaning component, which may typically be configured as a blade component, or a fixed or rotating brush-like component, is to scrape or brush residual toner material from the surface of the intermediate transfer element with which the abrasive cleaning component is in contact. When configured as a rotating brush, a separate motor unit associated with the intermediate transfer element toner cleaning system may typically rotate the brush at a constant speed. The abrasive component may cause the removed residual toner to be directed to a toner transfer reservoir in the intermediate transfer element toner cleaning system.

The toner transfer reservoir of the intermediate transfer element toner cleaning system may include one or more outlets via which the removed residual toner may be transferred from the toner transfer reservoir to one or more toner transfer conduits that may be in fluid communication with a waste toner recovery receptacle. See FIG. 1. The waste toner recovery receptacle may be configured to be easily removable from image forming device in order that recovered residual toner may be further processed or otherwise properly disposed of.

In order to facilitate residual toner movement in the toner transfer reservoir of the intermediate belt toner cleaning system toward the one or more outlets, gravity feed of the residual toner material deposited in the toner transfer reservoir may be supplemented by an auger system. The auger system may, for example, be powered by the same separate motor unit that is used to power the rotating brush element of the intermediate transfer element toner cleaning system through a series of mechanical gears.

In operations, conditions are encountered in which a volume of toner being cleaned from the intermediate transfer element causes a toner input rate to the toner transfer reservoir to exceed an output rate of toner from the toner transfer reservoir through the one or more outlets, even as toner movement is augmented by auger movement. Under these conditions, the toner transfer reservoir volume will be exceeded and clogging of the intermediate transfer element toner cleaning system will typically ensue. Based on a complexity in configuration, a typical intermediate transfer element toner cleaning system is not customer serviceable. As such, when the above-described conditions occur, a service call is generally required. Extended periods of non-availability for the involved the image forming device may be encountered which may severely affect customer productivity.

This potential for clogging may be exacerbated based on toner conditions, which may be difficult for a customer to ascertain, including high toner age. The difficulties may also be more prevalent in, for example, high ambient temperature and/or high humidity operating environments for the toner-based image forming devices. Such conditions may promote clumping of the residual toner deposited in a toner reservoir in a cleaning system.

Size constraints driven by a desire to reduce a physical footprint of image forming devices in an office environment restrict options for addressing the clogging problems. For example, increasing a size of a toner reservoir beyond that which is necessary to account for a vast percentage of routine operations may present unacceptable tradeoffs for physical configurations in particular classes of image forming devices.

Likewise, operating the intermediate transfer element cleaning system auger constantly at a higher speed to facilitate an increased rate of removal of toner from the toner transfer reservoir may be equally undesirable. Increasing a constant operating speed for the cleaning components over that which is appropriate to account for a significant percentage of routine operations may unnecessarily increase routine power consumption of the cleaning system. Additionally, because the auger components and the rotating abrasive cleaning components may be mechanically linked, an increase in the speed of the auger to more aggressively aid in removal of the toner from the toner transfer reservoir would necessarily increase the speed of the rotating abrasive cleaning components. Rotating the abrasive cleaning components at a constant higher-than-normal/needed speed would result in additional wear being experienced by both the rotating abrasive cleaning component and the intermediate transfer element.

In order to address the above-identified shortfalls, it would be advantageous to provide systems and methods for sensing occasions of operations that may result in larger than normal volumes of residual toner needing to be removed from an intermediate transfer element by an intermediate transfer element toner cleaning system. Based on this sensing, an operating speed for an auger component in the intermediate transfer element toner cleaning system may be temporarily increased. This temporary increase in operating speed may address the intermittent increased toner volume conditions without introducing unacceptable physical configuration changes, or undesirable operating characteristic modifications, for the intermediate transfer element toner cleaning system.

Exemplary embodiments of the disclosed systems and methods may provide a variable speed motor drive system for an intermediate transfer element toner cleaning system in an image forming device. Upon sensing an actual or anticipated higher-than-normal amount of toner to be removed, a signal may be sent to temporarily increase a speed of operation of toner removal components in the intermediate transfer element toner cleaning system to account for the temporary increase in toner volume.

Exemplary embodiments may use image forming device "knowledge" of high volume toner operations, or of purge patch scheduling, to temporarily increase a variable motor speed for an intermediate transfer element toner cleaning system thereby addressing high volume toner removal without extensively affecting component life in the image forming device or otherwise requiring contacting manufacturers' service personnel to address resultant cleaning system clogging issues.

Exemplary embodiments may incorporate toner reservoir sensors in the intermediate transfer element toner cleaning system that may be used to direct temporary increases in operating speeds for the cleaning system to lessen unexpected accumulations of residual toner in a toner reservoir of the cleaning system.

Exemplary embodiments may provide a mechanism to implement a speed increase to a variable speed motor associated with an intermediate transfer element toner cleaning system during actual or anticipated high toner throughput occurrences to prevent waste toner buildup in the toner reservoir of the cleaning system. Because higher rates of residual toner removal often occur according to process control during toner purging, a predictable timing as to these events would provide a scheduling scheme for routine speed increases in the cleaning system.

In embodiments, a software command to temporarily increase the cleaning system motor speed could be issued prior to the stress cleaning condition. Toner clogging of the cleaner may be avoided and longer cleaner service life achieved.

Exemplary embodiments may lead to a reduction in a number of service calls and longer component life for the cleaning system and the intermediate transfer element.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing intelligent variable speed operations in an intermediate transfer element toner cleaning device will be described, in detail, with reference to the following drawings, in which.

DETAILED DESCRIPTION OF THE DISCLOSED EMBODIMENTS

The systems and methods for implementing intelligent variable speed operations in an intermediate transfer element toner cleaning device for a toner-based image forming system according to this disclosure will generally refer to this specific utility or function for those systems and methods. Exemplary embodiments described and depicted in this disclosure should not be interpreted as being specifically limited to any particular configuration of the described elements, or as being specifically directed to any particular intended use. Any advantageous use of variable speed elements to account for temporary stress conditions that may lead to excessive volumes of toner needing to be removed from imaging elements in a marking subsystem in an image forming device are contemplated as being included in this disclosure.

Specific reference to, for example, conventional image forming devices, intermediate transfer elements or cleaning systems, principally those for cleaning toner receiving elements in image forming devices, should not be considered as, in any way, limited to any specific configurations for such devices, or as being limited to only those devices. Exemplary embodiments as depicted and described throughout this disclosure are intended to refer globally to toner-based image forming devices and systems that carry out a wide array of image forming operations, particularly those employing charged toner particles as the marking medium and as those image forming operations would be familiar to those of skill in the art.

Figure 1:
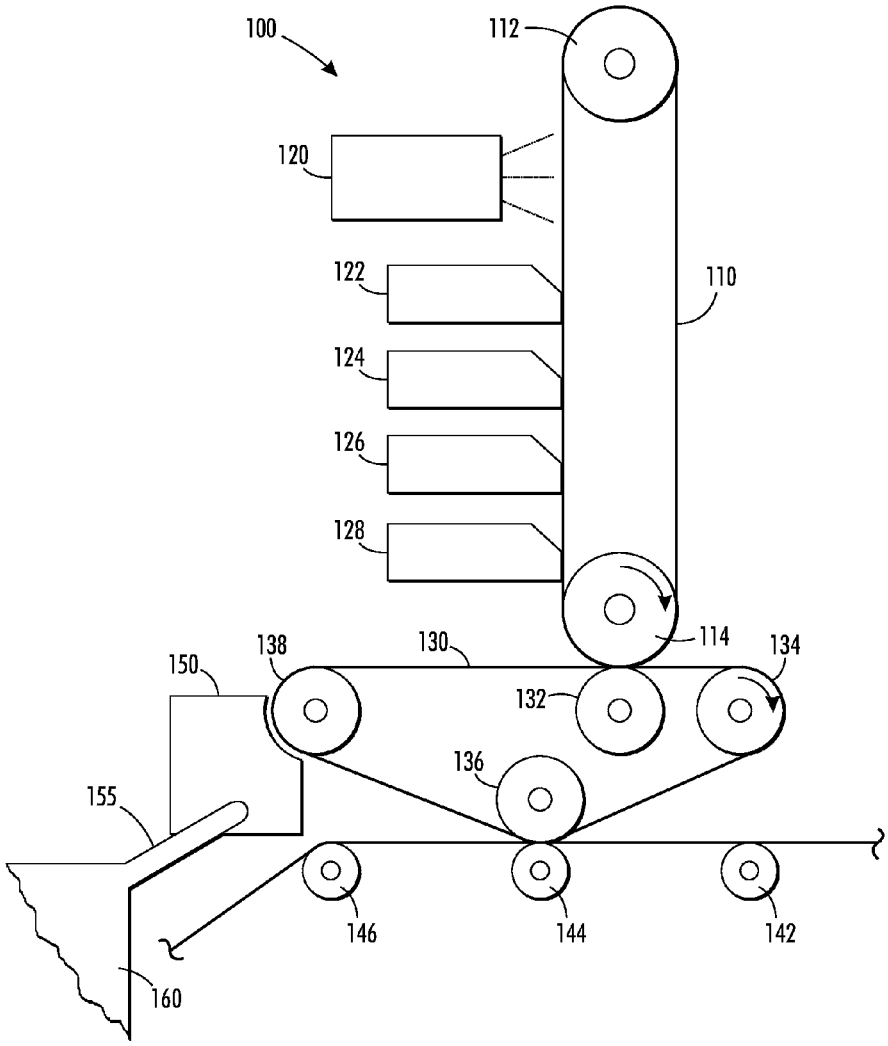
FIG. 1 illustrates a schematic representation 100 of components that support a basic operation of a xerographic image-on-image toner-based transfer in an image forming device, including an intermediate transfer component.
Figure 2:
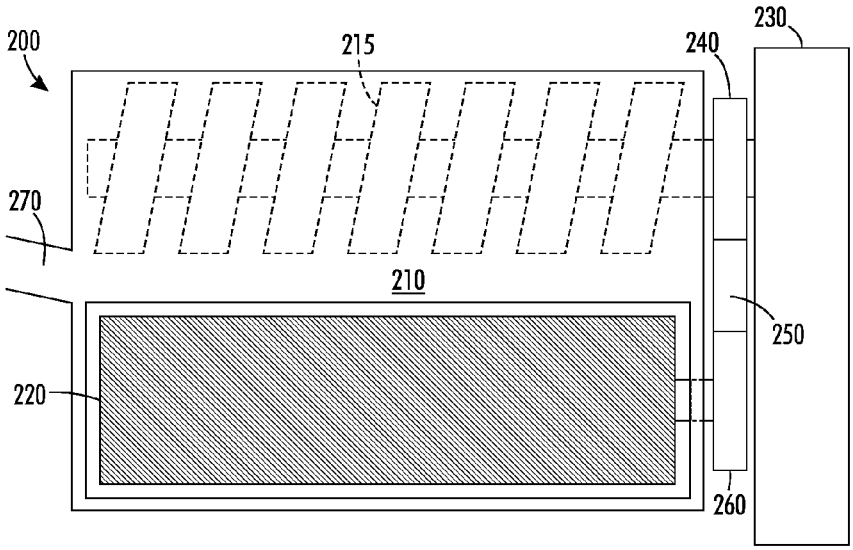
FIG. 2 illustrates a spanwise view of an exemplary intermediate transfer element toner cleaner usable with the systems and methods according to this disclosure.

FIG. 2 illustrates a spanwise view of an exemplary intermediate transfer element toner cleaner 200 ("cleaner") usable with the systems and methods according to this disclosure. As shown in FIG. 2, the cleaner 200 may include a toner sump 210 in which an auger 215 is situated. The cleaner 200 may include an abrasive cleaner component 220 in a form, for example, of a rotatable brush element, the bristles of the rotatable brush element being configured to contact an intermediate transfer element in a manner that promotes removal of residual toner from the intermediate transfer element. In operation, residual toner collected by the abrasive cleaner component 220 may be deposited in the toner sump 210. The residual toner deposited in the toner sump 210 may be moved, by action of the auger 215 toward one or more outlets 270. A variable speed motor unit 230 may be provided to drive the auger 215 via an auger drive shaft. The single variable speed motor unit 230 may also impart a driving motion to the abrasive cleaner component 220 via a series of driving gears 240,250,260.

Figure 3:
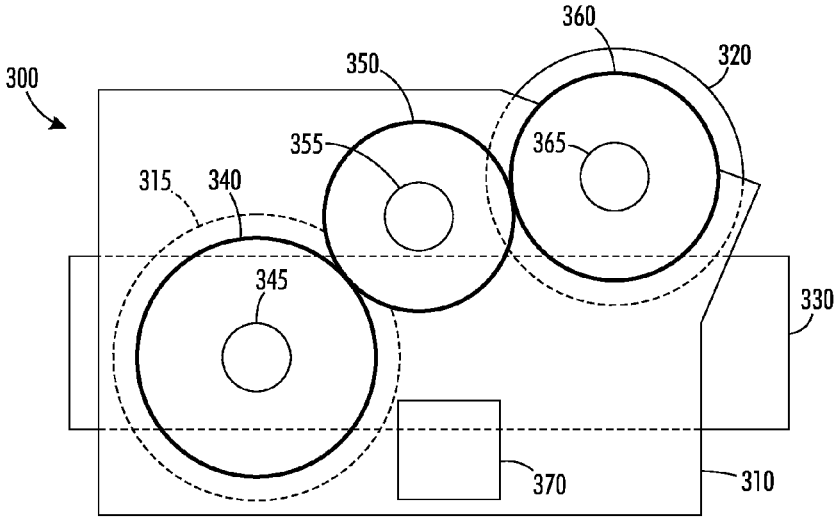
FIG. 3 illustrates a side view of an exemplary intermediate transfer element toner cleaner usable with the systems and methods according to this disclosure.

FIG. 3 illustrates a side view of an exemplary intermediate transfer element toner cleaner 300 ("cleaner") usable with the systems and methods according to this disclosure. As shown in FIG. 3, the cleaner 300 may include a toner sump 310 in which an auger 315 is situated. The auger 315 may be mounted on an auger drive shaft 345. The cleaner 300 may include an abrasive cleaner component 320 in a form, for example, of a rotatable brush element, the bristles of the rotatable brush element being configured to contact an intermediate transfer element in a manner that promotes removal of residual toner from the intermediate transfer element. The abrasive cleaner component 320 may be mounted on an abrasive cleaner component drive shaft 365. In operation, residual toner collected by the abrasive cleaner component 320 may be deposited in the toner sump 310. The residual toner deposited in the toner sump 310 may be moved, by action of the auger 315 toward one or more outlets 370. A variable speed motor unit 330, which is depicted in FIG. 3 as being mounted on an opposite end on the cleaner 300, may be provided to drive the auger 315 via the auger drive shaft 345. The single variable speed motor unit 330 may also impart a driving motion to the abrasive cleaner component 320 via a series of driving gears 340,350,360 mounted on respective shafts 345, 355,365. The series of driving gears 340,350,360 (240,250, 260 in FIG. 2) may be mounted on either end (the end adjacent the variable speed motor unit 330 (230 in FIG. 2) or opposite the variable speed motor unit 330 (230 in FIG. 2) of the respective shafts 345, 355, 365.

Figure 4:
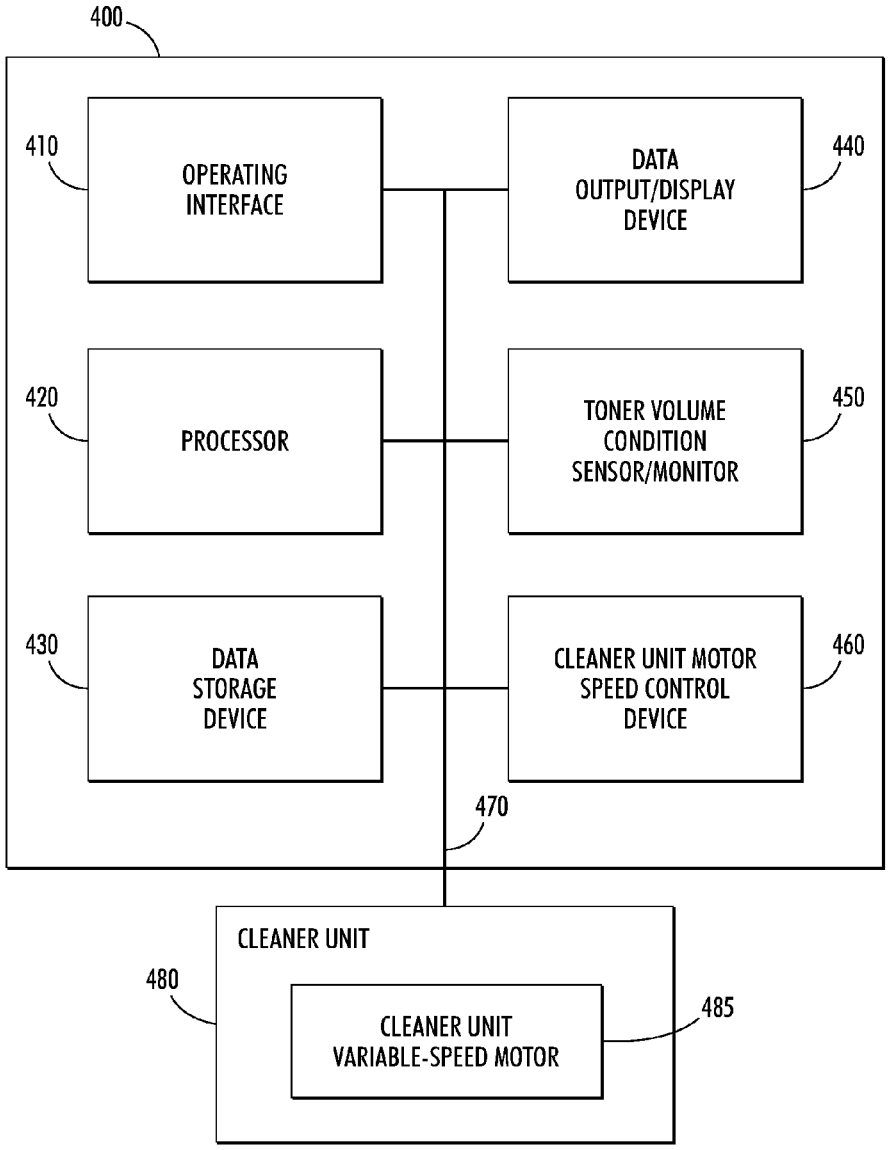
FIG. 4 illustrates a block diagram of an exemplary control system for implementing intelligent variable speed operations in an intermediate transfer element toner cleaning device according to this disclosure.

FIG. 4 illustrates a block diagram of an exemplary control system 400 for implementing intelligent variable speed operations in an intermediate transfer element toner cleaning device ("cleaner unit 480") according to this disclosure. All or some of the components of the exemplary control system 400 may be included in an image forming device housing the intermediate transfer element and the cleaner unit 480. Otherwise, certain of the components, particularly for undertaking processing and control functions, may be housed in, for example, a separate computing device that may be associated with the image forming device.

The exemplary control system 400 may include an operating interface 410 by which a user may communicate with the exemplary control system 400. The operating interface 410 may be a locally accessible user interface associated with an image forming device. The operating interface 410 may be configured as one or more conventional mechanisms common to control devices and/or computing devices that may permit a user to input information to the exemplary control system 400. The operating interface 410 may include, for example, a conventional keyboard, a touchscreen with "soft" buttons or with various components for use with a compatible stylus, a microphone by which a user may provide oral commands to the exemplary control system 400 to be "translated" by a voice recognition program, or other like device by which a user may communicate specific operating instructions to the exemplary control system 400. The operating interface 410 may be a part of a function of a graphical user interface (GUI) mounted on, integral to, or associated with, the image forming device with which the exemplary control system 400 is associated.

The exemplary control system 400 may include one or more local processors 420 for individually operating the exemplary control system 400 and for carrying out operating functions of the variable speed motor control methodology in an image forming device with which the exemplary control system 400 may be associated. Processor(s) 420 may include at least one conventional processor or microprocessor that interprets and executes instructions to direct specific functioning of the exemplary control system 400 and of the cleaner unit variable-speed motor 485 in, or associated with, the cleaner unit 480.

The exemplary control system 400 may include one or more data storage devices 430. Such data storage device(s) 430 may be used to store data or operating programs to be used by the exemplary control system 400, and specifically the processor(s) 420. Data storage device(s) 430 may be used to store information regarding individual variable speed control schemes for operating the cleaner unit variable-speed motor 485 associated with cleaner unit 480 in the image forming device. These stored schemes may control motor speed, for example, to increase motor speed based on actual, potential or pending toner volume conditions in the cleaner unit 480. The data storage device(s) 430 may include a random access memory (RAM) or another type of dynamic storage device that is capable of storing updatable database information, and for separately storing instructions for execution of system operations by, for example, processor(s) 420. Data storage device(s) 430 may also include a read-only memory (ROM), which may include a conventional ROM device or another type of static storage device that stores static information and instructions for processor(s) 420. Further, the data storage device(s) 430 may be integral to the exemplary control system 400, or may be provided external to, and in wired or wireless communication with, the exemplary control system 400.

The exemplary control system 400 may include at least one data output/display device 440, which may be configured as one or more conventional mechanisms that output information to a user, including, but not limited to, a display screen on a GUI of the image forming device with which the exemplary control system 400 may be associated. The data output/display device 440 may be used to indicate to a user a status of a rate of toner removal from the cleaner unit 485 in the image forming device and also to advise the user of a speed of operation of the cleaner unit variable-speed motor 485 associated with the cleaner unit 480. The cleaner unit variable-speed motor 485 may be accelerated to support increased toner removal from the cleaner unit 480 based on a determination that a rate of toner collection into the cleaner unit 480 exceeds a rate of toner removal from the cleaner unit 480.

The exemplary control system 400 may include a toner volume condition sensor/monitor 450. The toner volume condition sensor/monitor 450 may include one or more remote sensors that may be placed, for example, in a toner transfer sump in the cleaner unit 480 to sense an actual toner level in the toner transfer sump. Otherwise, the toner volume condition sensor/monitor 450 may be associated with an operating scheme for the image forming device. In embodiments, the toner volume condition sensor/monitor 450 may provide the exemplary control system 400 with a capability to determine that (1) a user-directed imaging operation, or (2) a scheduled, or manually-initiated, purge operation, may involve a volume of toner that will leave an excessive amount of residual toner on one or more toner carrying components in the image forming device. An ability of the toner volume condition sensor/monitor 450 to sense actual or forecast excessive toner volume conditions may aid in a determination in the exemplary control system 400 to temporarily increase an operating speed of the cleaner unit variable-speed motor 485, via a cleaner unit motor speed control device 460, as discussed below. The toner volume condition sensor/monitor 450 may operate as a part of a processor 420 coupled to, for example, one or more data storage devices 430, or as a separate stand-alone component module or circuit in the exemplary control system 400. The toner volume condition sensor/monitor 450 may provide input to the exemplary control system 400 to send a signal to the data output/display device 440 to advise a user that certain action is being taken in the image forming device to address a temporary over-volume condition in the cleaner unit 480. Additionally, or separately, the toner volume condition sensor/monitor 450 may send a signal to activate a scheme to increase a speed of operation of the cleaner unit variable-speed motor 485 according to the discussion above.

The exemplary control system 400 may include a cleaner unit motor speed control device 460. The cleaner unit motor speed control device 460 may receive a signal from the toner volume condition sensor/monitor 450 to increase or decrease an operating speed of the cleaner unit variable-speed motor 485 based on the above-discussed determinations to maintain an optimum operating speed for the cleaner unit 480 to address actual or forecast amounts of residual toner on one or more toner carrying components in the image forming device that need to be cleaned and processed by the cleaner unit 480. An ability of the toner volume condition sensor/monitor 450 to sense actual or forecast excessive toner volume conditions may aid in a determination in the exemplary control system 400 to temporarily increase an operating speed of the cleaner unit variable-speed motor 485, via a cleaner unit motor speed control device 460, as discussed below. The cleaner unit motor speed control device 460 may operate as a part of a processor 420 coupled to, for example, one or more data storage devices 430, or as a separate stand-alone component module or circuit in the exemplary control system 400.

All of the various components of the exemplary control system 400, as depicted in FIG. 4, may be connected internally, and to the image forming device by one or more data/control busses 470. These data/control busses 470 may provide wired or wireless communication between the various components of the exemplary control system 400, whether all of those components are housed integrally in, or are otherwise external and connected to an image forming device with which the exemplary control system 400 may be associated.

It should be appreciated that, although depicted in FIG. 4 as an integral unit, the various disclosed elements of the exemplary control system 400 may be arranged in any combination of sub-systems as individual components or combinations of components, integral to a single unit, or external to, and in wired or wireless communication with the single unit of the exemplary control system 400. In other words, no specific configuration as an integral unit or as a support unit is to be implied by the depiction in FIG. 4. Further, although depicted as individual units for ease of understanding of the details provided in this disclosure regarding the exemplary control system 400, it should be understood that the described functions of any of the individually-depicted components may be undertaken, for example, by one or more processors 420 connected to, and in communication with, one or more data storage device(s) 430.

Figure 5:
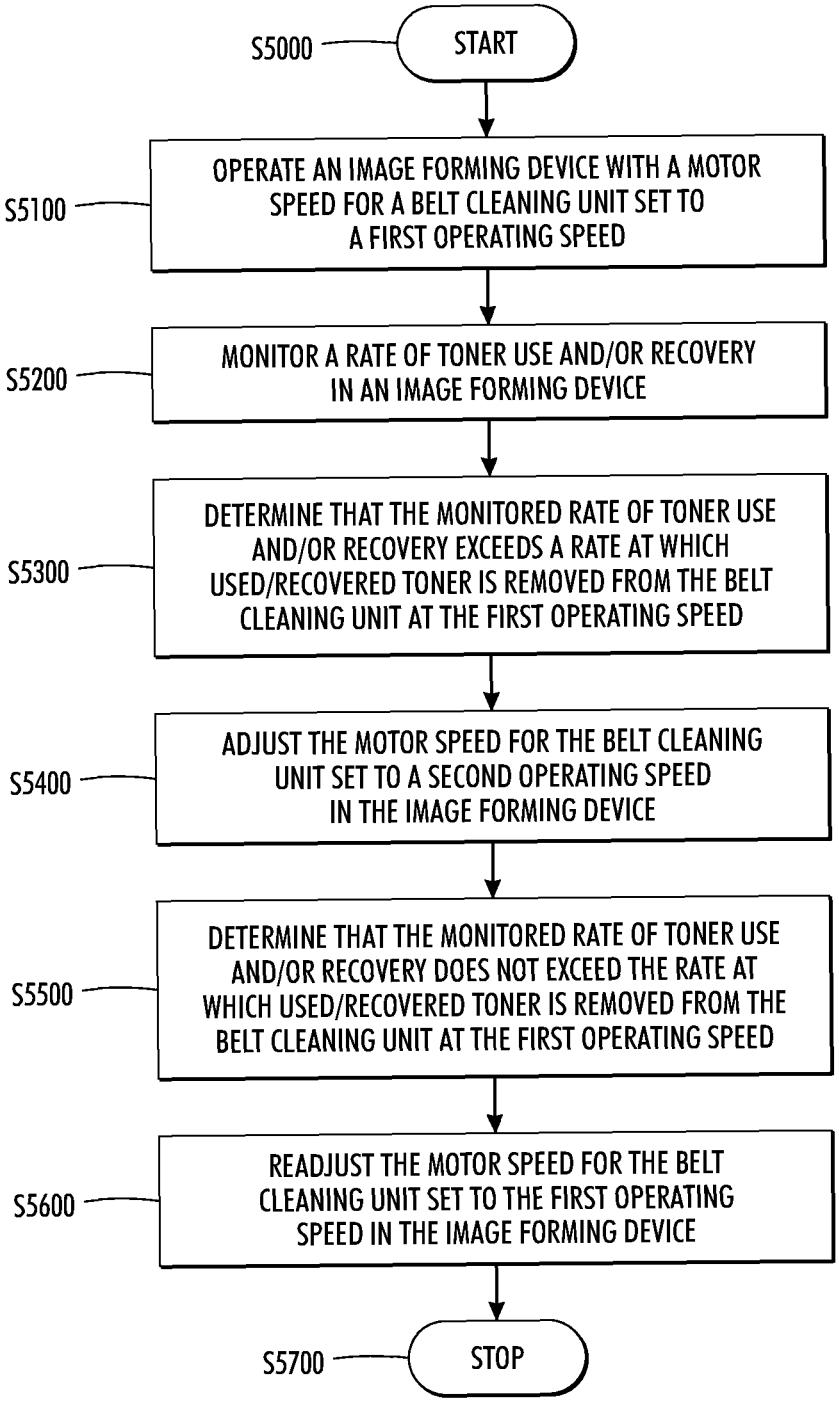
FIG. 5 illustrates a flowchart of an exemplary method for implementing intelligent variable speed operations in an intermediate transfer element toner cleaning device according to this disclosure.

The disclosed embodiments may include an exemplary method for implementing intelligent variable speed operations in an intermediate transfer element toner cleaning device. FIG. 5 illustrates a flowchart of such an exemplary method. As shown in FIG. 5, operation of the method commences at Step S5000 and proceeds to Step S5100.

In Step S5100, an image forming device may be operated such that a motor speed for a belt cleaning unit is set to a first operating speed. The first operating speed may be a nominal motor operating speed for operation of the belt cleaning unit that is appropriate to cover a large percentage of the operating conditions, including residual toner volume conditions, with which the belt cleaning unit may be confronted in operation. The large percentage of the operating conditions may be, for example, in excess of 90% of all normal image forming operating conditions. Operation of the method proceeds to Step S5200.

In Step S5200, a rate of toner use and/or required residual toner recovery in the image forming device may be monitored. Operation of the method proceeds to Step S5300.

In Step S5300, a determination may be made that the monitored rate of toner use and/or a rate of required residual toner recovery in the image forming device may exceed a rate at which the recovered residual toner may be processed by the belt cleaning unit in the image forming device when the belt cleaning unit is operated at the first operating speed. This determination may be made based on sensed toner over-volume conditions in the image forming device or may otherwise be based on current or projected operating conditions for the image forming device that may result in additional residual toner being generated that must be processed by the belt cleaning unit. Operation of the method proceeds to Step S5400.

In Step S5400, a motor speed for the belt cleaning unit may be set (increased) to a separate second operating speed to address the temporary over-volume condition regarding the residual toner in the image forming device. Operation of the method proceeds to Step S5500.

In Step S5500, a determination may be made that the continuing monitored rate of toner use and/or required toner residual toner recovery in the image forming device is now reduced to a point that it will not exceed a rate at which the recovered residual toner may be processed by the belt cleaning unit in the image forming device when the belt cleaning unit is operated at the first operating speed. This determination may be made based on sensed toner volume conditions in the image forming device or may otherwise be based on current or projected operating conditions for the image forming device returning to nominal levels over those operating conditions that generated the additional residual toner for processing in the belt cleaning unit. Operation of the method proceeds to Step S5600.

In Step S5600, a motor speed for the belt cleaning unit may be set (decreased) to the first operating speed to deal with the nominal toner-generating conditions in the image forming device. Operation of the method proceeds to Step S5700, where operation of the method ceases.

The disclosed embodiments may include a non-transitory computer readable medium on which is recorded instructions for executing a monitoring and motor speed control scheme, as described above.

The above-described exemplary systems and methods reference certain conventional components to provide a brief, general description of suitable image forming means, image forming control means, and residual toner recovery and processing means by which to carry out image forming in a system using toner as an image marking material.

Those skilled in the art will appreciate that other embodiments of the disclosed subject matter may be practiced with many types of image forming elements common to toner-based systems in many different configurations.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 5, and the accompanying description, except where a particular method step is a necessary precondition to execution of any other method step. Individual method steps may be carried out in sequence or in parallel in simultaneous or near simultaneous timing Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A method for controlling an image forming system, comprising:

conducting toner transfer operations in an image forming system, the toner transfer operations generating residual toner;

operating a toner cleaning unit in the image forming system at a first speed to process the residual toner;

determining, with a processor, that the residual toner is generated at a first rate, the first rate exceeding a rate that the toner cleaning unit processes the residual toner when the toner cleaning unit is operated at the first speed; and operating the toner cleaning unit at a second speed that is higher than the first speed based on a result of the determining, further comprising monitoring a rate at which the residual toner is generated, the monitoring comprising sensing a changing volume of the residual toner in a toner transfer sump in the toner cleaning unit.

2. The method of claim 1, the residual toner being generated at the first rate during high volume multi-color image forming operations.

3. The method of claim 1, the residential toner being generated at the first rate during toner purge operations.

4. The method of claim 1, the toner cleaning unit comprising a variable speed motor, the method further comprising sending a signal to the variable speed motor to change an operating speed for the motor from one speed that drives the toner cleaning unit at the first speed to another speed that drives the toner cleaning unit at the second speed.

5. The method of claim 1, further comprising:

determining, with the processor, that the residual toner is generated at a second rate, the second rate being less than the rate that the toner cleaning unit processes the residual toner when the toner cleaning unit is operated at the first speed; and operating the toner cleaning unit at the first speed based on the result of the determining.

6. The method of claim 1, the sensing employing one or more sensor elements in the toner transfer sump.

7. The method of claim 1, the monitoring comprising identifying that the image forming system receives a command to execute an operation that is pre-determined to generate the residual toner at the first rate.

8. The method of claim 7, the operation that is pre-determined to generate the residual toner at the first rate being a high volume multi-color image forming operation.

9. The method of claim 7, the operation that is pre-determined to generate the residual toner at the first rate being a toner purge operation.

10. An image forming system, comprising:

a marking device for toner transfer operations, the toner transfer operations generating residual toner;

a toner cleaning unit that is operated at a first speed to process the residual toner;

a determining device that determines a rate at which the residual toner is generated; and a speed control device associated with the toner cleaning unit to operate the toner cleaning unit at a second speed that is higher than the first speed only when it is determined that the rate at which the residual toner is generated is greater than a rate that the toner cleaning unit processes the residual toner when operating at the first speed;

further comprising a monitoring device that monitors a rate at which the residual toner is generated, the monitoring device senses a changing volume of the residual toner in a toner transfer sump in the toner cleaning unit by employing one or more sensor elements in the toner transfer sump.

11. The image forming system of claim 10, the toner cleaning unit comprising a variable speed motor that receives a signal to change an operating speed for the variable speed motor from one speed that drives the toner cleaning unit at the first speed to another speed that drives the toner cleaning unit at the second speed.

12. The image forming system of claim 10, the monitoring device identifying that the image forming system receives a command to execute an operation that is pre-determined to generate the residual toner at the first rate.

13. The image forming system of claim 12, the operation that is pre-determined to generate the residual toner at the first rate being at least one of a high volume multi-color image forming operation and a toner purge operation.

* * * * *